US005463787A

United States Patent [19]

Burke et al.

[11] Patent Number: 5,463,787

[45] Date of Patent: Nov. 7, 1995

[54] GAME-BALL CONDITIONER

[76] Inventors: Lawrence M. Burke, P.O. Box 1402, De Leon Springs, Fla. 32130; Ronald L. Shalla, P.O. Box 3189, De Land, Fla. 32723

[21] Appl. No.: 165,227

[22] Filed: Dec. 10, 1993

[51] Int. Cl.[6] ..... A63B 47/04

[52] U.S. Cl. ..... 15/97.1; 15/21.2

[58] Field of Search ..... 15/21.2, 97.1

[56] References Cited

U.S. PATENT DOCUMENTS

| | | | |
|---|---|---|---|
| 1,889,809 | 12/1932 | Nielsen | 15/21.2 |
| 1,991,183 | 2/1935 | Sundahl | 15/21.2 |
| 2,540,687 | 2/1951 | Netterstrom | 15/21.2 |
| 3,084,360 | 4/1963 | Hasselroth | 15/21.2 |

FOREIGN PATENT DOCUMENTS

| | | | |
|---|---|---|---|
| 4117 | of 1883 | United Kingdom | 15/21.2 |
| 203108 | 6/1922 | United Kingdom | 15/21.2 |

*Primary Examiner*—Edward L. Roberts, Jr.

[57] ABSTRACT

An apparatus for conditioning the surface of spheroidal game balls including a spherical enclosure, a hand crank, an array of fixed, compliant surface-shear pads, a top port for inserting soiled game balls, a rotating disc shaped member to ensure firm contact between game ball and shear pads and propel them along the surfaces of the pads, a reservoir of conditioning fluid covering a portion of pads and disc shaped member and a bottom drain port for flushing out weakened, spent or dirty conditioning fluid.

8 Claims, 2 Drawing Sheets

GAME-BALL CONDITIONER

BACKGROUND OF THE INVENTION

1. Field of the Invention

The field of this invention is unpowered devices and processes for surface conditioning of various types of game balls, including those which are basically spherical and near-spherical forms as well as other spheroidal articles.

2. Description of Prior Art

Baseballs pick up stains and mud during use when the game is played outdoors. The horsehide leather cover and seams are typically cleaned by hand to remove natural surface deposits as well as rosin or gums which are sometimes intentionally applied by the players. Whitening agents may also be used to restore the bright color of a new ball. No publication could be found which discloses a manual or powered cleaner/conditioner for baseball covers.

Golf balls are subject to much greater levels of surface contamination due to their "inward-dimpled" surface texture and frequent impacts with foliage, algae in water traps, and clay mud in bunkers. Balls used in other games such as croquet are also subject to accumulation of surface soil which impairs their impact, flight or rolling performance.

Several motor-powered scrubbers have been disclosed to clean large numbers of golf balls as might be used in a driving range. U.S. Pat. No. 4,805,251, Hollrock (1989), depicts a combination of a motor-driven, horizontal rotating brush drum and a spaced set of curved, stationary ball-guides. In operation, several hundred balls are fed into the cleaner from a hopper and the rotation of the brush causes them to move as a "string of pearls" along the track in a smooth, continuous, circular/helical path and be transported finally to the exit chute. U.S. Pat. No. 4,773,114, Thrasher (1988), discloses a similar apparatus with a spiral cage to guide the balls along the rotating brush drum. Typical golf-ball cleaners for a driving range run at a fixed speed, rotate in only one direction as required to move the balls at high speed from the input chute to the output, and frequently water for cleaning is fed continuously from a hose, so there is no sump with attendant buildup of removed soil. These large units are maintained and operated by range staff and are capable of handling up to 9000 balls per hour to clean off limited surface soil typical of a driving range which has no water/mud hazards. Careful control of ball speed and trajectory is required in such machines to avoid excess dimple wear and surface damage such as cuts, scratches and abrasions from the corners of fixed guides and edges of the chutes. No evidence can be found that such high-speed, powerful machines have been miniaturized for lightweight battery drive and use on a golf cart or attached to a golf bag.

So called "pocket" cleaning devices for soiled golf balls tend to be small chambers for cleaning a single ball such as disclosed in U.S. Pat. No. 4,473,917, Britton (1984). This unit incorporates a cylindrical housing about 2–3 ball diameters long with a threaded cover and fixed helical bristle strip attached to its interior surface. Cleaning is accomplished by putting a ball into the chamber, closing the top cover, and shaking vigorously to propel the ball back and forth inside the bristle chamber. Frequently, the automatic-ball-ejection features of such devices are a strong selling point; the user does not have to reach into the device, which may be covered with dirty water and slime, to remove the "cleaned" game ball. Units of this general type typically can hold no more than about 25–50 milliliters of water, which requires either precleaning of gross soil from the game balls or frequent replacement of the water. If these precautions are not taken, the "cleaned" balls will be covered with muddy water which must be removed by additional "post-cleaning" steps such as wiping and rinsing. In this and similar devices without means to assure positive rotation of the golf ball against the cleaning elements, the movements of the ball are linear, sliding displacements along the axis of the container cylinder. No "pocket" golf-ball cleaner can be found which assures removal of mud caked into the dimples of a golf ball. This and similar devices are promoted for use by the sportsperson who may be wearing white or light-colored clothing which would be stained by spills of contaminated waste from the bail scrubber. Regrettably, the "pocket" devices exhibit a number of less than ideal characteristics such as weight, bulk, and inefficient cleaning of anything except small amounts of light soils. Another unacceptable problem is gradual leakage of the contaminated waste while the scrubber is being carried in the user's pocket; this frequently results in embarrassing spots and stains to costly, high-fashion apparel. One obvious limitation of the "pocket" cleaners is the requirement for wearing slacks with one or more capacious pockets to carry the device and associated supplies, etc.

No method or apparatus for cleaning game balls can be found which teaches the use of aqueous-type cleaning fluids which do not leave a scum of soap residue or water-hardness minerals on the surface of the golf ball. Neither can any reference be found in old-art game-ball cleaners to the use of non-aqueous fluids, solutions, emulsions, or liposomes which produce a thin continuous surface film on the game ball which is hydrophobic, i.e., not wettable by ordinary water and mud. Similarly, the use of enzyme additives in cleaning fluids cannot be found in patents for old-art, game-ball cleaners.

SUMMARY OF THE INVENTION

The ball-conditioning devices of this invention are used not only to remove objectionable surface deposits and stains/discolorations but may also apply a coating or film of a selected beneficial agent. Such agents may be selected to improve: (a) the external appearance of the ball or (b) the mechanical/aerodynamic characteristics of the ball, including coefficient of surface friction with the club face, elastic energy storage in the surface layers and amount of elastic deformation of the surface under impact. Surface conditioning includes a series of conditioning steps involving frictional contact between the several cleansing elements of the present apparatus and the surfaces of the soiled ball in the presence of controlled quantities of conditioning fluids. In the case of golf or tennis balls with a specific surface texture, the combined action of deflecting filaments and conditioning fluids/additives can be used to apply a specific surface-film coating or nap brush pattern.

The main object of this invention is to provide a simple, manual cleaning device which can remove soils from the surface of a few game balls at one time. This invention has been specifically developed to overcome the many problems and limitations of old-art cleaners including: (a) leakage of dirty water during and after use, (b) requirement for additional, inconvenient pre- and post-cleaning steps due to small sumps, small fluid volume, and poor cleaning efficiency, (c) inadequate shear/scrubbing contacts between the ball surface and the cleaning elements (d) poor circulation of the cleaning fluid to transfer removed debris to the sump so that it is not recirculated, (e) requirement for heavy electric-motor drive, (f) requirement for daily maintenance to assure clean brushes and the correct level of fresh water, (g) lack of flexibility to permit vigorous alternating/reversing modes of the drive mechanism to achieve quicker cleaning of heavy soils, (h) not flexible to permit variable speed, intermittent or jerk-wise operation to achieve exaggerated zig-zag scrubbing movements of the ball, (i) lack of large, easy-access top port for inputting and removing balls from the apparatus, (j) lack of self cleaning design for internal components so that user is not subjected to reaching down into the mechanism which is covered with mud and filthy water to insert or retrieve each ball and (k) requirement for daily maintenance to assure safe, reliable, jamfree operation of ejection devices which lift the "cleaned" ball for easy removal or eject it outward from the machine.

Rotation of the hand-operated crank arm of this invention at various speeds and rotation modes provides motive power to accomplish many types of conditioning contacts between the ball, the notch surfaces, and the several compliant cleaning elements. One or more selected conditioning fluids with additives may be contained within the lower zone of the apparatus; this fluid is formulated to dissolve and disperse the surface soil so that a game ball emerges "conditioned" and free of soil and or other surface residues which could impair its performance. Surfactants may be added to the fluids to keep the soil agents finely divided and dispersed for the useful life of the conditioning fluid. Operation of the conditioning unit of this invention transports fluid from the sump zone to wet out all the compliant elements; even gentle rotation of the crank produces a self-cleaning action of the fixed and moving internal elements, so that the user does not have to reach into a dirty zone of the machine to deposit and retrieve balls.

Another object of this invention is to provide a game-ball conditioning device which is efficient in terms of the time and work required to clean a few balls as might be needed by each player during the course of the game. By proper choice of the height of the crank axis at about waist level above the ground, the cleaner can easily be operated by a small adult or adolescent. In most cases, the game ball is freshly cleaned immediately before it is put into play, and the player may wish to prepare 1–5 additional conditioned balls for use at later stages of the game. The large, covered top access port and selfcleaning features of this device are greatly appreciated because soil residues from previous use are not transferred to the user's hands or gloves in removing the conditioned balls.

A second object of this invention is to provide an efficient game-ball cleaning method and apparatus which is capable of cleaning even dried, caked mud from the dimples of a golf ball.

Another object of this invention is to provide a game-ball conditioning device which does not suffer from the common problems of prior ball cleaners, namely the propensity to spill, leak, or splash dirty cleaning fluid on high-fashion apparel worn by the user—leaving embarrassing, unsightly stains and spots.

Still another object of this invention is to provide an attractive, distinctive spherical-shaped, weather-proof device which can be permanently installed outdoors and will require only minimal maintenance and fluid replenishment. The use of a sealed enclosure prevents evaporation of the fluids with attendant problems. of sludge formation in the sump zone. Because of the characteristic Spherical design and the location of the bottom drain port, complete drainage is assured and winterization with anti-freeze additives is quick and easy.

Still another object of this invention is to provide a conditioning device which can be used to maintain game balls such as those used for golf, baseball, softball and tennis in clean, prepared surface condition consistent with the highest competitive levels of play.

BRIEF DESCRIPTION OF THE DRAWINGS

FIG. 1 also shows the point of maximum depth of the game-ball notch.

DESCRIPTION OF THE BEST MODE EMBODIMENTS

Figure 2A:
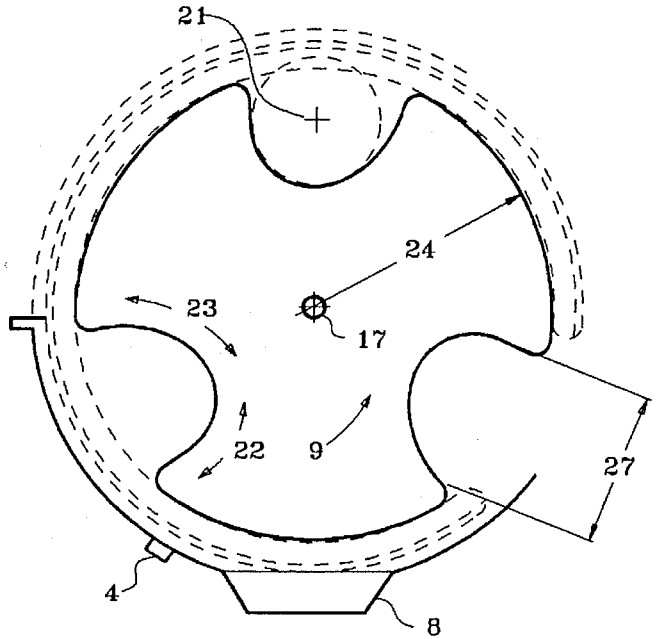
FIG. 2A. is a view showing details of the disc shaped member, especially the shape of the game-ball notch, and the locations of the notch leading edge and notch trailing edge zones.
Figure 1:
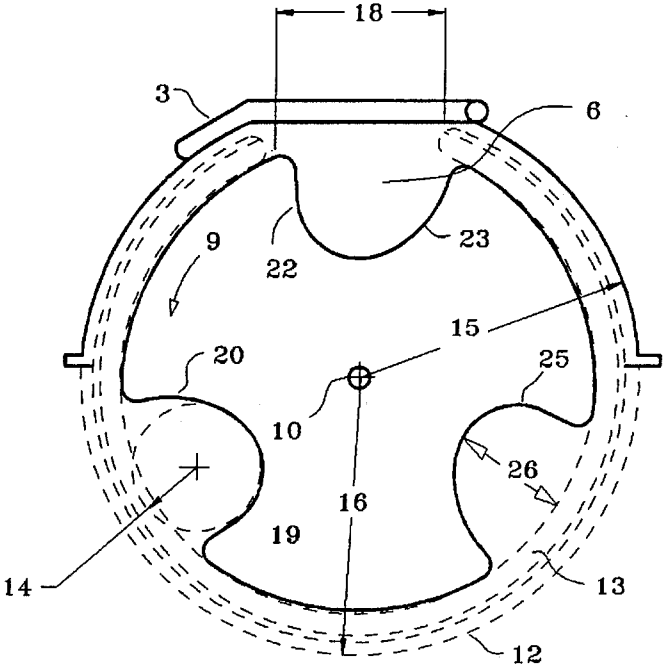
FIG. 1 is a cut-away view which shows the main elements of the game ball conditioner of this invention and their assembled physical relationships.
Figure 3:
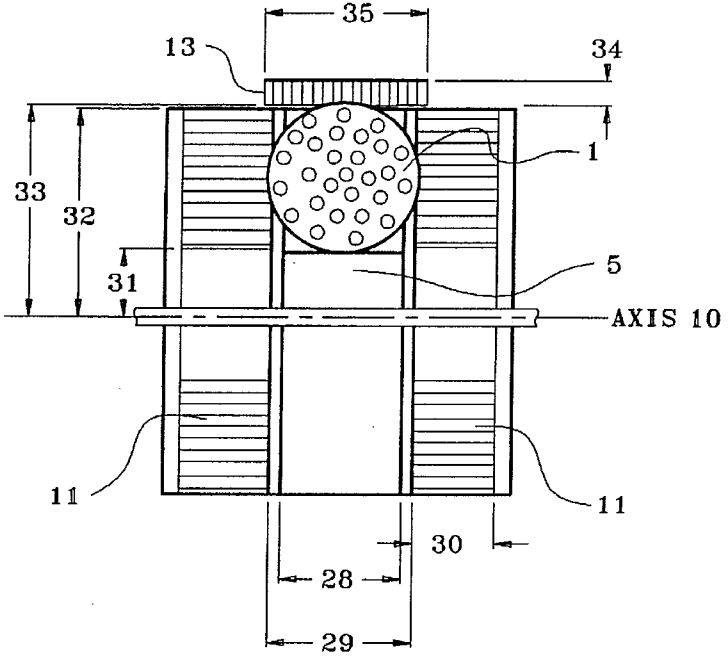
FIG. 3 is a cut-away detail view of the circumferential pad, opposing hispid pads and typical deflections of their filaments by a game ball encompassed in the game-ball notch.
Figure 2B:
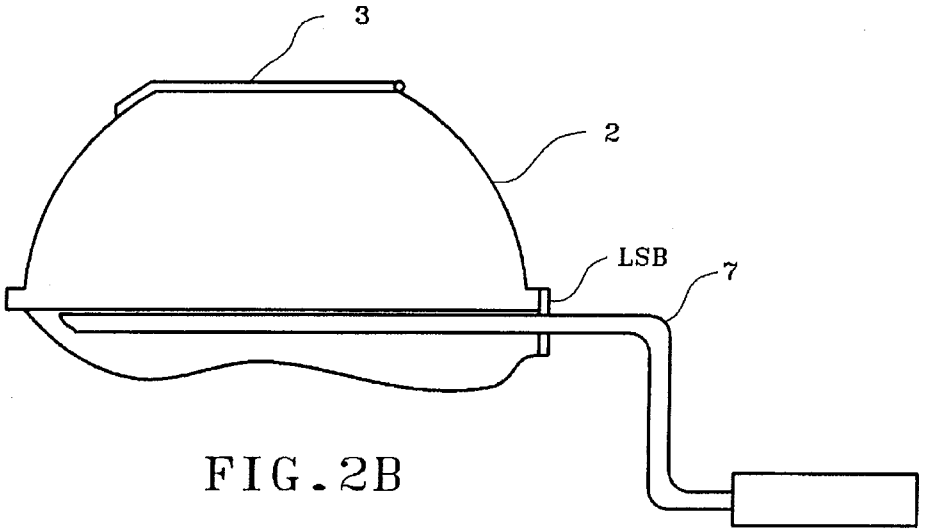
FIG. 2B. is a general view which shows the relationship of the hand crank and the upper half element of the spherical shell.

FIGS. 1–3 shows general views and sectional details through the game-ball washer. The game-ball washer of this invention operates upon one or more soiled game balls (1). The main elements are: the generally spherical enclosure (2), which consists of mating top and bottom half shells sealingly assembled together; (3) pivoting, sealable top port for the input or removal of game balls; (4) a sealable bottom port for draining dirty conditioning fluid; the rotatable disc shaped member (5) with 3–5 game-ball notches (6) fixed to hand crank (7) which rotates about an axis (10); (7) the forward or clockwise sense of rotation of hand crank; downward-facing post-attachment socket (8) on exterior of bottom half shell; 2 opposing washer-like, hispid side pads (11) fixed to the shell on opposite sides of the disc shaped member and spaced apart from the lateral surfaces of (5); a circumferential pad (13), which is fixed to circumferential support ring (12) which is fixed to the spherical enclosure (2), located adjacent to the rim of the disc shaped member (5) and extending between the outer diameters of the opposing washer-like hispid pad structures (11) over their entire circumference except in the zone of the top port (3) where it is absent to provide easy access to deposit or remove balls; the pivoting, sealable top port, (3); the threaded, sealable bottom port (4); the hand crank (7) having a pair of liquid-sealed bushings, which are located in the mating/sealing zone of the upper and lower shell halves and an axis (10) which extends generally as a diameter of the spherical enclosure across the mating plane; and the downward-facing post-attachment socket (8) adapted for receiving and attaching securely to a mounting post which extends approximately to adult waist level above the ground surface.

This manual-drive conditioner is designed to clean and condition game balls of radius R1 by scrubbing actions between the hispid pads, disc shaped member, game-ball notch and the action of a fluid. In operation, the user opens the top port (3) and places a soiled game ball (1) in one or more of the game-ball notches. After closing the top port, conditioning is accomplished by turning the hand crank (7) in the forward direction, indicated by the arrow (9). Depending upon the amount and adhesion of the soil, movements amounting to 5–20 revolutions of the hand crank may be required for cleaning. The cleaned, conditioned balls are removed by reversing the charging steps described above.

FIG. 2A shows a the disc shaped. member (5) having a outer rim radius (24) and a detailed view of the game-ball notches; the radius range for (24) is 20–400 mm and the R1-scaled value is approximately 2.6. The thickness of the disc shaped member is measured parallel to axis 10; the thickness is in the range 15–300 mm and the R1-scaled value is approximately 0.9. For the purpose of this specification and claims the game ball diameter means the maximum measured diameter when the game ball is held between two flat, parallel surfaces. As can be seen, the leading edge of the notch for forward rotation is a circular arc over the zone (22) with a radius of curvature given by (25); the radius range is 20–350 mm and the R1-scaled value is approximately 1.1. Similarly, the trailing edge zone, (23), is a conic curve such as an ellipse or parabola. Such curves can be defined by a polynomial of degree two, i.e., an equation having squared terms. These two zones intersect and are tangent at the point of maximum depth of the notch; this point and the maximum depth dimension, (26), are also indicated in FIG. 1; the maximum notch depth is in the range 30–680 mm and the R1-scaled value is approximately 1.8. The maximum notch depth is measured radially inward from the outside rim of the disc shaped member (5). The minimum notch width between the ends of the leading and trailing edge zones is denoted by (27); the minimum notch width is in the range 21–400 mm and the R1-scaled value is approximately 2.14. When the crank is turned in the forward direction (9), a game ball encompassed within the notch is subject to several frictional interactions with the notch surfaces, the contact zone of the circumferential ring and the contact zone of the hispid side pads. The arctuate leading edge zone of the notch (19) is textured to enhance the frictional interactions with the ball being cleaned. Likewise, the trailing edge texture zone of the notch (20) is also textured. The center point of the leading-edge arc zone is indicated by (21). Studies and modeling of these forces indicate that the rapid cranking at a constant rate produces a wide range of variations and moment-to-moment fluctuations with the result that the soiled game ball is subject to vigorous, irregular, continuous movements between the curved leading and trailing zones (22) and (23) of the game-ball notch (6). Likewise, alternative turning modes including combinations of reversing and partial rotations of the hand crank produce even more erratic movements between the game ball, the notch, the hispid pads (11) and the circumferential pad (13). The notch surface texture patterns in (19) and (20), and their frictional interactions with the game ball across the curved notch portions (22) and (23) of the disc shaped member can play a significant role in the amplitude of game ball movements during hand crank strokes. Simple non-directional texture patterns, analogous to a "sandpaper" texture of random-height, random-spaced surface projections/indentations, cause a tangential spin coupling with the ball parallel to the zone face, especially on the notch trailing edge zone during forward rotation. This produces additional spin-shear-scrubbing actions/deflections of the ball against the hispid pads and circumferential pad filaments. Directional texture patterns, such as an array of parallel ribs set at a selected orientation angle to the sidefaces of the disc shaped member, are capable of imparting additional twisting moments to alter the motion of the encompassed ball. The simplest way of characterizing a notch leading edge zone or notch trailing edge zone surface texture is the so-called root-mean-square or RMS roughness, which defines the texture in terms of the height of the average projections above the mean centerline of a planar surface. In this format, an alternative parallel pattern of notch leading edge zone or notch trailing edge zone ribs each R1/30 wide and spaced from adjacent ribs by a distance of R1/30, set at an angle of 45 deg. to the disc shaped member sideface and standing a height of 0.02 R1 above the basic plane of the surface would have a RMS roughness of approx. 0.01 R1. Likewise, an alternative sparse, random notch leading edge zone or notch trailing edge zone pattern of 50–100 conic-pyramidal surface projections per 100 sq. mm, each 0.01 R1 high would have an RMS roughness of approx. 0.01 R1. Since notch leading edge zone or notch trailing edge zone texture patterns are subject to wear degradation after extended use, these should be prepared as formable polymer strip inserts which can be easily attached to the inner surface of the game-ball notches by known fixation methods and hand access through the top port.

FIG. 3 shows a sectional view of the 2 opposing, spaced-apart hispid pads, (11). The pads are composed of a parallel array of elongated filaments one end of which is encapsulated into a supporting polymer matrix. Typical filaments range in diameter from 0.1 to 0.9 mm and in length from 3 to about 40 mm. The free, uncompressed total thickness of the pads is given by (30). The pads are prepared in the form of washer-like flat plates with an inner radius (31) and an outer radius (32). The inner radius (31) relative to axis (10) is in the range 10–40 mm and the R1-scaled value is approximately 0.6. The outer radius (32) relative to axis (10) is in the range 60–400 mm and the R1-scaled value is approximately 3.6. The pads are supported by corresponding rigid plates in spaced-apart planes perpendicular to the axis (10) so that their opposing surfaces, which consist of the cut tips of the filaments, are generally parallel and separated by a distance (29), which is less than the diameter of the game ball. The minimum distance (29) between the uncompressed tips of hispid-pad filaments is in the range 32–560 mm and the R1-scaled value is approximately 1.71. The uncompressed thickness of the hispid pads, as measured parallel to the filament axis, is in the range 10–40 mm and the R1-scaled value is in the range 0.2 to 1.5. When a game ball is placed into a notch, the filaments of the pads are elastically deflected around the surface features of the ball. As the disc shaped member is rotated by turning the hand crank, an encompassed game ball is propelled along an irregular, zig-zag path about the axis (10). This motion produces a shear scrubbing action of the compressed pads and deflected filaments which contact the ball surface features. The rotating notch causes the ball to be immersed into the liquid reservoir in the bottom half of the enclosure; a portion of the pads is always immersed in the conditioning liquid. Conditioning fluid carried on the surface of the disc shaped member and ball to the non-immersed zones of the hispid pads is drained along the inner periphery and back into the reservoir sump. This drainage also carries away debris removed from the ball surface. Depending upon the structure of the filaments and the matrix into which they are embedded, significant amounts of fluid may also be "wicked" upward from the sump to maintain the pads in a wetted state.

FIG. 3 also shows a sectional view of the circumferential pad which is composed of a band of filaments with its cylindrical inner surface spaced apart from the axis (10) by the radial distance (33). The circumferential pad is basically a band or strip of compliant filaments of free, uncompressed thickness (34) which is supported on a curved rigid structure. The maximum radius, relative to axis (10), to the uncompressed filament tips of the circumferential pads is indicated by (33); this radius falls in the range 75–130 mm and the R1-scaled value is approximately 3.93. The maximum uncompressed thickness of the circumferential pads, measured radial to axis (10) is in the range 10–4-mm and the R1-scaled value is in the range 0.2–1.5. The width of the circumferential pad is indicated by (35), which is measured parallel to axis (10), is in the range 40–680 mm and the R1-scaled value is the range 2.1 to 2.2. As shown in FIG. 1, the circumferential pad does not wrap 360 degrees around the disc shaped member (5), but has an opening or slot, of minimum dimension (18), facing the upper port which allows a game ball to be placed by the fingers through the circumferential-pad gap and directly into the aligned notch opening.

When the disc shaped member is rotated, an encompassed game ball is translated along an irregular path. into a zone where it comes in contact with the pad fibers of the circumferential pad (13) and hispid pad (11) and produces a controlled deflection and compression of the contacting fibers. For the case of circumferential-pad filaments extending in a generally-radial direction relative to the axis (10), the filaments are bent along the ball surface and into its features, such as dimple patterns, and produce a strong shear scrubbing action when the crank is rotated. In operation, conditioning fluid is carried to upper portions of the circumferential pad by capillary action from the immersed zone and also by surface entrainment on the game ball member.

Characteristic dimensions of the major elements are shown as ranges of actual values for various sizes/types of game balls, i.e., from golf balls to basketballs. Since the design of the present ball-conditioning apparatus is completely general for any ball-like object, it is desirable to express its characteristics in the most general terms. The generalized formalism is useful to adapt the design for alternative uses such as cleaning/conditioning any ball-like object such as bearings, fruits, vegetables, eggs, light bulbs, etc. The description above also indicates the dimensions in scaled, or generalized parametric form, i.e., normalized by dividing the actual dimensional value by the actual radius of the game ball or spheroidal object.

A number of thermosetting and thermoplastic polymer materials can be used successfully for preparation of the spherical shell halves, disc shaped member, top port, bottom port, liquid-sealing support bushings for drive rod (17) and post-attachment socket (8) by molding or casting methods. These include the following polymer families: ABS, FEP, acrylics, amides, esters, siloxanes, urethanes, olefins, etc. Matrix-mounted parallel filament arrays for hispid pads and circumferential pads include all thermoplastic compounds which are normally available in the form of solid or hollow fibers such as polyester, polypropylene, polyethylene, etc. For long wear and best cleaning action, the filament diameter should be in the range 0.1–0.3 mm for circumferential pads and 0.1–0.5 mm for the hispid pads; propylene filaments have shown a desirable combination of properties and are impervious to typical additives which may be used in the conditioning solutions. Corrosion-resistant Al-base, Cu-base non-ferrous alloys as well as stainless steel have also been used for structural elements such as top port, bottom port, hand crank, and internal supports for the circumferential pads and hispid pads.

EXAMPLES

Example 1.0

Post-Mounted Conditioner for Golf Balls.

Table 1 lists the preferred range of characteristic dimensions of a golf-ball conditioner according to this invention.

Example 2.0

Alternate Materials/Structures for spherical shell, disc shaped member, hispid pad, and circumferential pads.

Models for testing this invention on golf balls have been made from various common plastics and all found acceptable. Polypropylene filaments in the range 0.2–0.5 mm diam. have been used with excellent results for hispid pads and circumferential pads.

Example 3.0

Alternative Conditioning Fluids and Resulting Films, Coating and Surface Layers.

For competitive play, surface treatments, thin films or processes which alter the mechanical-impact characteristics of the golf-ball cover are not allowed. However, common anionic, non-anionic, and amphoteric surfactants with sudsing additives, colorants, stabilizers and perfumes, which leave no thin-film residues and have no temporary or permanent effect upon the ball's mechanical characteristics have been used for golf-ball conditioning. For non-competitive play and experimental purposes, conditioning additives which impart desirable characteristics to the surface of a game ball are of wide interest. The following are some desirable ball surface characteristics which can be produced by conditioning: surface dye color for easy identification, non-wettable surface, super-smooth surface, special thin surface films with low air resistance, special thin surface films to impart optimal turbulence conditions during flight, special thin surface film to impart a selected degree of surface-friction resistance between ball and club face, etc. Typical conditioning fluid additives are based upon aqueous solvents and additives may be in the form of liquid emulsions, solid tablets, dye solutions, sols, e.g., liquids with fine-disperse particles of organic, or inorganic materials, etc. Dispersed or dissolved film-forming materials are added to the conditioning fluid to smooth over mechanical surface scratches in the ball cover in the manner that paste wax produces a shine on scuffed shoes or boots. Such smoothing/conditioning would improve the flight performance of the golf ball and would not alter elastic-impact properties. The additives for this include the general class of micrometer-size particles of dispersed waxes, gels and polymer microspheres such as acrylics or urethanes. Fine-disperse additives such as abrasive particles or adhesive-like gels are used to produce a thin surface film which increases the coefficient of surface friction at impact between the ball and the club face.

TABLE 1

R1-SCALED DIMENSIONS FOR A GOLF-BALL CONDITIONER EMBODIMENT WITH 3–5 GAME BALL NOTCHES

Dimensions of shell, support ring, top port and drive rod:

- 14, game-ball radius, mm (2R1=D1) re center of gravity, R1-scaled value=1.00;
- 15, internal radius of shell enclosure, R1-scaled value approx. 5.10;
- 16, radius of support ring, R1-scaled value approx. 4.50
- 17, radius of drive rod, 4–10 mm, R1-scaled value approx. 0.20 and
- 18, min. dimension of top port, mm (min. hand hole= 100 mm), actual range in mm 100–70, typical R1-scaled value, 2.00.

Dimensions and form of disc shaped member and game-ball-notch:

19, notch leading edge zone texture, RMS texture in the range $1.1\times10^{-5}$ R1 to $1\times10^{-4}$ R1;

20, notch trailing edge zone texture, RMS texture in the range $1.1\times10^{-5}$ R1 to $1\times10^{-4}$ R1;

24, rim radius of disc shaped member, R1-scaled value approx. 2.60;

25, notch leading edge zone arc radius relative to notch center point 21, R1-scaled value approx. 1.10;

26, max. radial notch depth from edge relative to axis 10, R1-scaled value approx. 1.80;

27, min. notch width at ends of notch leading edge zone and notch trailing edge zone, R1-scaled value approx. 2.14; and

28, thickness of disc shaped member, meas. parallel to axis 10, R1 -scaled value approx. 0.90.

Dimensions of opposing, parallel hispid pads:

29, min. filament-tip distance between hispid pads, uncompressed, R1-scaled value approx. 1.71;

30, uncompressed thickness of hispid pad, meas. parallel to filament axis, R1-scaled value approx. 0.2–1.5;

31, inner radius of washer-like hispid pad, re axis 10, R1-scaled value approx. 0.60; and

32, outer radius of washer-like hispid pad, mm re axis 10, R1-scaled value approx. 3.60

Dimensions of circumferential pads:

33, max. radius to uncompressed filament tips of circumferential pads, meas. from axis 10, R1-scaled value approx. 3.93;

34, max. uncompressed thickness of circumferential pads, meas radial from 10, R1-scaled value approx. 0.2–1.5; and

35, width of circumferential pads, mm meas. parallel to axis 10, Ri-scaled value approx. 2.14.

We claim:

1. A manual-drive apparatus supported on an adjustable-height, permanent mounting post in an upright orientation above the ground for easy one-arm rotation of a crank lever by normal adults for cleaning and conditioning the external surfaces of soiled, spheroidal game balls having an actual or equivalent external radius R1, comprising:

(a) an impermeable spheroidal shield enclosure (2) consisting of upper and lower rigid, interlocked, sealed, arctuate component halves which form a spheroidal internal cavity of internal radius (15) with a lower sump zone, the internal radius of which falls in the range 8 R1 to 20 R1, and said sump zone containing a volume of liquid conditioning fluid sufficient for cleaning and conditioning a soiled game ball, said conditioning fluid consisting of a continuous phase and sufficient dispersed or dissolved amounts and forms of active agents to clean and impart desirable surface properties to said game ball, said enclosure lower half-shell being formed with an external mounting-post socket (8) appropriate for removable attachment to said mounting post, (a1) said upper component of said enclosure having at least one closeable, resealable upward-facing access port (3) situated at its highest point for hand-insertion of soiled game balls into said enclosure, (a2) said lower component of said enclosure having at least one closeable, resealable downward-facing sump-drain port (4) situated at its lowest point, and wherein said access port and said sump-drain port are fitted with gasket means to prevent outward leakage of the liquid conditioning fluid and inward seepage of environmental contaminants;

(b) an elongated drive rod having first straight end and second crank-handle (7) ends separated by a straight, axiallysymmetric central zone having a midpoint and a length greater than the external diameter of said spheroidal shield enclosure and positioned within said shield such that said first and second ends protrude from the exterior of said enclosure and the central zone axis (10) extends diametrically in a generally horizontal direction across the internal cavity of said shield enclosure, said drive rod being supported adjacent to its ends by independent bearing sleeves fittingly secured into preformed recesses in each of the enclosure elements, said bearing sleeves being fitted with non-drip seals and adapted for leak-free rotation of said drive rod about said central zone axis (10) inside said enclosure by application of manual force to said crank handle (7) formed integral with said second end of said drive rod;

(c) a disc shaped member (5) of thickness (28) less than 1.2 R1 and external rim radius (24) less than said shell internal radius, fixed at its rotational center to said midpoint of said center zone of said drive rod, adapted for free revolution about said axis within said shield enclosure and at least partially immersed into said contained minimum volume of liquid conditioning fluid, (c1) said disc shaped member having a set of least three spaced-apart peripheral notches (6) extending through the full thickness thereof, each said notch open to said external rim diameter, each having a maximum depth (26) less than 2 R1 as measured radially inward from said rim diameter, and a minimum width (27) greater than 2 R1, (c1a) each said peripheral notch having a first curved, leading zone (19) of first surface texture and a second, curved trailing zone (20) of second different surface texture, said zones being located on opposite sides of said point of maximum notch depth and adapted to interact with game-ball surface during rotation of said disc shaped member, and (c1b) each said peripheral notch being of shape and angular extent to encompass one of said soiled game balls placed in said notch and, upon rotation of the disc shaped member with said drive rod about said drive axis, to impart a plurality of irregular rotational and translational movements to said soiled game ball during each rotation of said disc shaped member;

(d) a pair of fixed, compliant, flat, opposing hispid shear pads (11) mounted on parallel, planar supports on opposite sides of said disc shaped member and spaced apart a distance (29) such that individual filaments of said shear pads exert controlled flexural and shear interactions with external surface features of said encompassed soiled game balls due to rotation of said disc shaped member around said drive axis and through said minimum contained volume of conditioning fluid, each said pad being prepared in the shape of a flat washer with an outer radius (32) smaller than said internal radius of the shell enclosure (15), an inner radius (31) larger than 0.5 R1 and a thickness (30) in the range 0.1–1.5 R1, (e) a curved compliant, circumferential pad (13) of width (35) less than 3 R1 and thickness (34) in the range 0.1–1.0 R1 and composed of an array of encapsulated filaments mounted on a curved ring support band (12) extending approximately 80% around the outer periphery of said shear pads, having a gap of approximately 20% of the circumference of said shear pads the center of which is oriented to face the center of said top access port (3) and spaced apart a radial distance (33) from rotation axis of said disc shaped member such that a game ball encompassed in said notch will be subject to controlled flexural and shear interactions with said circumferential pad filament array due to rotation of said disc shaped member, (f) wherein said free-surface spacing distance (29) between said hispid shear pads is set to produce at least 10% thickness compression of the free thickness of each of said pads by a game ball encompassed in said notch during rotation of said disc shaped member, (g) wherein said radial free-surface spacing distance (33) between the circumferential ring and said rotation axis is set to produce at least 10% thickness compression of said circumferential pad free thickness by a game ball encompassed in said notch during rotation of said disc shaped member, (h) wherein the radius (25) of curvature of said curved leading zone (19) is in the range 1.01 to 1.20 R1, and extends over an arc of approximately 90 deg. from the point of maximum notch depth toward said external rim, and said first surface texture is defined by a root-mean-square roughness of R1/90000 to R1/25, (i) wherein the geometric form of said curved trailing zone (20) is defined by a polynomial equation of less than degree 4 which extends from said point of maximum notch depth (26), where it is tangent to said leading edge zone, in a generally radial direction toward said external rim, and said second surface texture is defined by a root-mean-square roughness of R1 /90000 to R1/25

(j) whereby during vigorous rotation of said crank handle, as user faces the apparatus and cranks in a clockwise direction with the right hand, said notch trailing surface zone follows behind said leading surface zone and said encompassed game ball is forced by cam actions into strong interaction with said curved trailing surface, hispid pads and circumferential pads which result in irregular, random-direction circulating movements within the notch, (k) whereby upon charging at least one soiled game ball through the access port (3) and into one of said notches (6) and, after closing said access port, applying manual torques to said crank handle (7) in a sequence of continuous, reversing or intermittent motions sufficient to accomplish repeated rotational interactions between the surface of the soiled balls and the wetted active filaments of said shear pads and circumferential pad, undesired surface soils and deposits are removed from the game ball and retained in the liquid sump zone of the enclosure lower half-shell until discharged with the contaminated conditioning fluid which is completely drainable by gravity from said drain-sump port (4), (l) whereby upon completion of sufficient movements of the crank handle the cleaned game ball, including a thin film of liquid conditioning fluid, is manually removable by opening said top access port when said disc shaped member is positioned with one of said notches oriented toward said top access port and any excess of said liquid conditioning fluid film still remaining on said conditioned game ball is partially removed by brushing/wiping with an absorbent material and any still-remaining remnant allowed to evaporate into the air, and (m) whereby highly desirable surface characteristics including freedom from original soil, and other attributes, particularly coefficients of surface friction for air flow around said game ball in flight and flat-face mechanical impacts, microhardness and wettability by aqueous solutions, as well as other remarkable surface qualities, which are all controllable and directly related to exposure to said sufficient levels of active agents contained in said conditioning fluid, are imparted to said game ball surface.

2. The game-ball conditioner of claim 1 wherein said size parameters fall into the following ranges:

radius of disc shaped member (24), 49–60 mm,
notch leading edge zone arc radius (25), 21–25 mm,
max. radial notch depth from rim (26), 34–42 mm,
min. notch width (27), 40–49 mm,
thickness of disc shaped member (28), 17–21 mm,
min. tip spacing of opposing hispid pads, uncompressed (29), 32–40 mm,
thickness of hispid pad, uncompressed (30), 10–40 mm,
inner radius of hispid pad (31), 11–14 mm,
outer radius of hispid pad (32), 68–83 mm,
max. radius from axis (10) to circumferential pad, uncompressed (33), 74–91 mm,
max. thickness of circumferential pad uncompressed (34), 5–40 mm,
width of 13 (35), 40–49 mm,
said surface texture for leading zone (19) and trailing zone (20) are in the range R1/90000 to R1/10000 RMS and the conditioning fluid is an aqueous solution with one or more additives chosen from the group anionic, non-anionic, and amphoteric surfactants
said additives being present in amounts sufficient to remove soil from golf balls.

3. The game ball conditioner of claim 2 wherein the conditioning fluid is an aqueous solution which contains sufficient amounts of one or more dissolved or dispersed film-forming additives which, upon drying, will produce a hydrophobic surface film on the surface of a regulation golf ball.

4. The game ball conditioner of claim 2 wherein said conditioning fluid is an aqueous solution which contains additives in amounts sufficient to produce a scratch-filling, hydrophobic surface coating on the surface of a regulation golf ball with typical light surface scratches.

5. The game-ball conditioner of claim 2 wherein said surface texture zone (19) and (20) are formed integral into said notch surface by bonding arrays of individual particles of wear-resistant material to said zones.

6. The game-ball conditioner of claim 2 wherein said surface texture zones (19) and (20) are formed by bonding of strips of textured material to said zones.

7. The game-ball conditioner of claim 2 wherein said surface texture zones (19) and (20) are formed by bonding a strip of first texture to said zone (19) and a strip of second texture, different from said first texture, to aid zone (20).

8. The game-ball conditioner of claim 7 wherein said strip of textured material is selected from the group consisting of: polymer strips with embossed texture, embossed-textured metal strips, polymer strips with embeded grit particles, and polymer strips with adhered grit particles.

* * * * *